United States Patent [19]

Cofer

[11] 3,949,976

[45] Apr. 13, 1976

[54] TRACTOR STANDS

[76] Inventor: Robert E. Cofer, 1011 Central, Dodge City, Kans. 67801

[22] Filed: Feb. 10, 1975

[21] Appl. No.: 548,575

[52] U.S. Cl. ..... 269/17; 254/2 B; 254/134; 280/47.15

[51] Int. Cl.[2] ..... B66F 5/04; B66F 7/28

[58] Field of Search ..... 254/2 B, 6 B, 7 B, 8 B, 254/9 B, 10 B, 133 A, 134; 269/17; 214/1 D; 248/352; 280/47.15, 150.5, 475

[56] References Cited

UNITED STATES PATENTS

| | | | |
|---|---|---|---|
| 685,011 | 10/1901 | Tell | 254/133 A |
| 1,211,373 | 1/1917 | Weaver | 254/7 B |
| 1,611,366 | 12/1926 | Peterson et al. | 254/8 B |
| 3,433,447 | 3/1969 | Carroll | 248/352 |
| 3,850,419 | 11/1974 | Craig | 254/134 X |

*Primary Examiner*—Al Lawrence Smith
*Assistant Examiner*—Robert C. Watson
*Attorney, Agent, or Firm*—John H. Widdowson

[57] ABSTRACT

A vehicle support stand structure having separate stands for the forward and rear portions of a vehicle. The stand normally used under the forward portion of the vehicle has a frame with a transverse portion having an elongated portion extending therefrom. A pair of vertically extendable upright members mount on the upper transverse portion and they in use mount on an underneath portion of a vehicle engine or the like. The other stand is usable under the rear portion of a vehicle or alternately under the forward portion of a vehicle. It has a frame with an elongated portion having a transverse portion on one end thereof and having a movable frame portion movably mounted on the elongated portion. A rear support member is vertically movably mounted on the movable frame portion. A pair of telescopic upright members are mounted on the transverse frame portion adjacent to the elongated portion. Auxiliary upright support members can be mounted on the transverse frame portion so this stand can be used under the forward portion of a vehicle.

6 Claims, 9 Drawing Figures

TRACTOR STANDS

BACKGROUND OF THE INVENTION

This invention is related to support stands for use in supporting portions of frameless vehicles when they are disassembled for maintenance. More specifically this invention is related to stands used for supporting the forward and rear portions of frameless or frame type agricultural tractors when the separable sections of the frameless structure are separated for maintenance.

Many stand like structures are known in the prior art for use in supporting engines, vehicles, and other machines when they are disassembled for maintenance. There are stands in the art specifically for the purpose of supporting separable sections of frameless agricultural type tractors, however, these stands have several disadvantages which makes them undesirable. Specifically the prior art tractor stands utilize plate like fixtures which are secured to portions of the vehicle to be separated and which are bolted to the stand. These members must be adjusted individually once the tractor is raised then secured in the mounted position and bolted accordingly so the stand is rigidly secured to the vehicle. This is a time consuming procedure by itself and it requires the use of a considerable quantity of bolts. The use of bolts alone to support these heavy structures is not completely desirable because they can twist off and shear in use thus, creating a potentially dangerous situation for the mechanic. Specifically in regard to the stand structures normally used with the front end portion of a tractor the stands consist of little more than vertical members having a plurality of holes and slots in their upper end portions and supported on casters. These specific structures must be securely attached to the tractor structure to support it and prevent it from falling once the tractor is separated. Some of the known front stands have upright members on the rear end portion thereof and another upright member on a forward portion which must be secured to the tractor as a brace to keep the rear uprights in position and keep the stand from tipping. In regard to the stands normally used with the rear portion of a tractor these must necessarily be quite sturdy because they support a large portion of the weight of a tractor. The known prior art stands have a frame structure which is vertically movably mounted on uprights that extend from castered members at each end of the stand. The structure to guide the vertically movable frame as it raises and lowers requires precise coordination between the opposed ends of the stands to prevent the frame from binding on the uprights.

One object of this invention is to provide a set of tractor stands which overcome the aforementioned disadvantages of the prior art devices.

Still, one other object of this invention is to provide a vehicle support stand structure for use in separating frameless or frame type agricultural type tractors which has a plurality of vertically extendable telescopic members that are individually attached to an underneath portion of a tractor.

Still, one other object of this invention is to provide a stand structure for supporting the forward end portion of a frameless tractor wherein the stand structure has a pair of telescopic upright members that can be easily adjusted and attached to an underneath portion of the tractor's engine or the like for supporting the rear end portion of the forward end portion of the tractor in combination with the front wheels of the tractor.

Yet, another object of this invention is to provide a support stand for the rear end portion of a frameless tractor wherein the stand has a plurality of telescopic members which can be easily attached to underneath portions of the tractor with the telescopic members being individually vertically adjustable.

Yet, another object of this invention is to provide a stand structure which can be used under the rear end portion of a frameless tractor or under the forward end portion of a frameless tractor to support the tractor when the forward and rear portions thereof are separated.

Various other objects, advantages, and features of the invention will become apparent from those skilled in the art from the following discussion taken in conjunction with the accompanying drawings, in which:

DESCRIPTION OF THE DRAWINGS

FIG. 2 is a top plan view of the rear stand of this invention in the configuration for use in supporting the rear end portion of a frameless tractor or the like;

Figure 1:
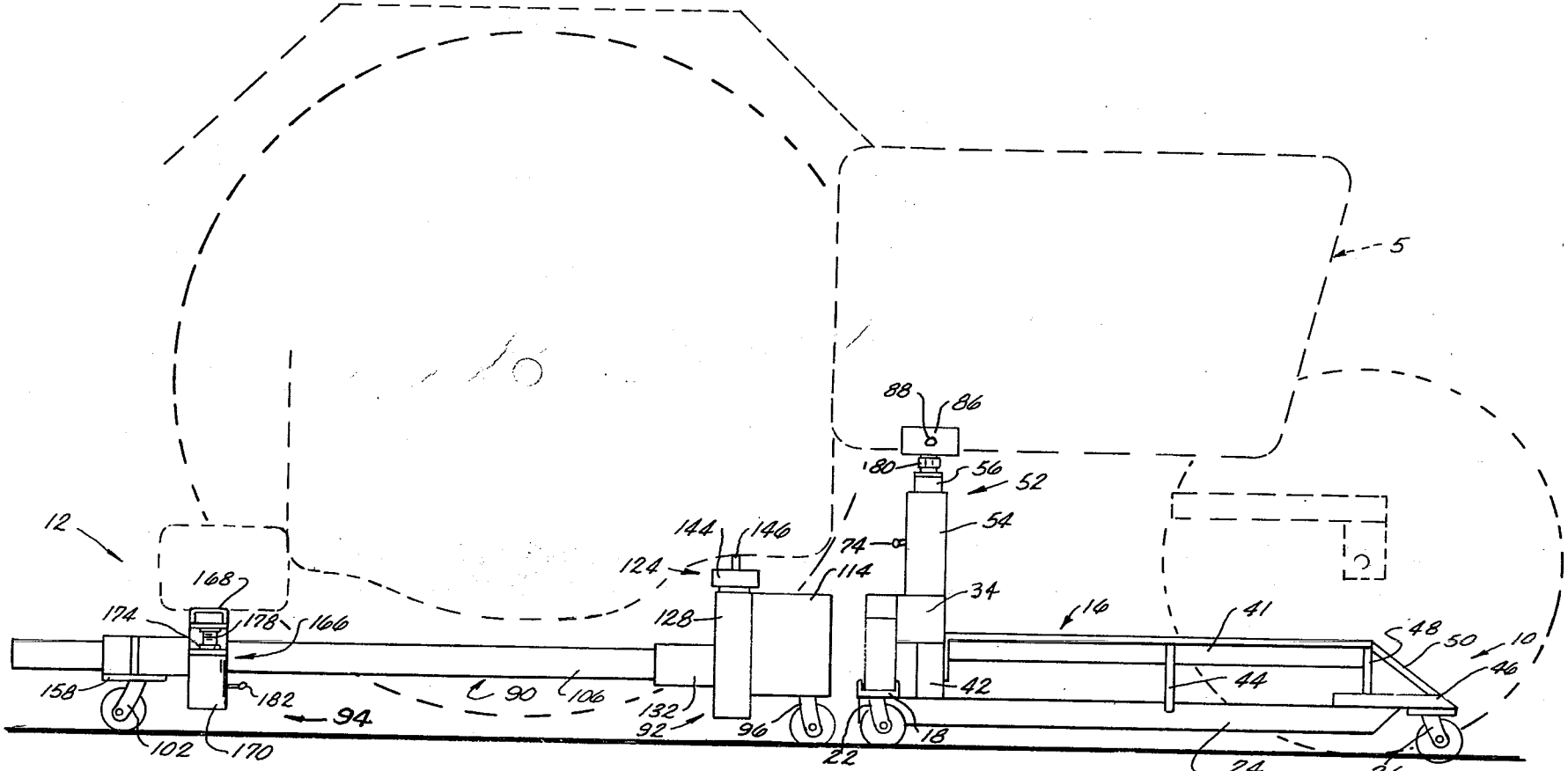
FIG. 1 is a side elevation view of both stands of this invention in normal mounted position underneath a frameless tractor. For clarity the tractor is shown in outline form in dashed lines.

The following is a discussion and description of preferred specific embodiments of the tractor stands of this invention, such being made with reference to the drawings whereupon the same reference numerals are used to indicate the same or similar parts and/or structure. It is to be understood that such discussion and description is not to unduly limit the scope of the invention.

DESCRIPTION OF PREFERRED EMBODIMENTS

Referring to the drawings in detail and in particular to FIG. 1 wherein the stands of this invention are shown in the normal mounted relation underneath a frameless tractor. The frameless tractor is shown in outline form in dashed lines and indicated generally at 5. The front stand is indicated generally at 10 and shown underneath the forward end portion of the frameless tractor 5. The rear stand is indicated generally at 12 and shown mounted underneath the rear portion of the frameless tractor 5. The stands 10 and 12 cooperate to support the tractor 5 so that the forward and rear portions of the tractor can be separated for maintenance. A frameless tractor 5 has a monocock type structure wherein the engine block or members secured thereto is mounted directly with the transmission or gear box portions of the tractor. In order to perform certain maintenance on the tractor 5 the separable segments must be separated. At this time the forward and rear portions of the tractor must be supported. The front stand 10 supports the forward end portion of the tractor in cooperation with the tractor's front wheels. The rear stand 12 supports the rear end portion of the tractor structure so the wheel assemblies can be removed. If desired the rear stand 12 can support the rear portion of the tractor in cooperation with the rear wheels of the tractor or it can support this assembly alone.

Figure 6:
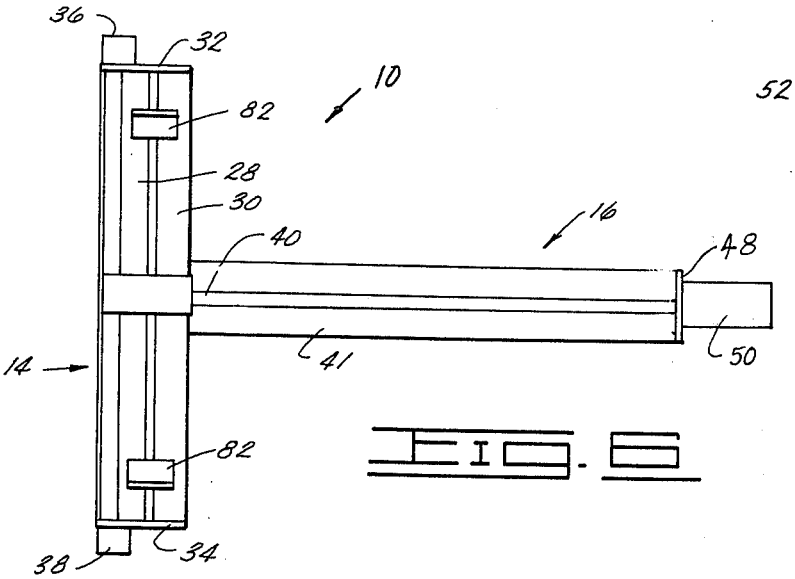
FIG. 6 is a top plan view of the front stand of this invention.
Figure 7:
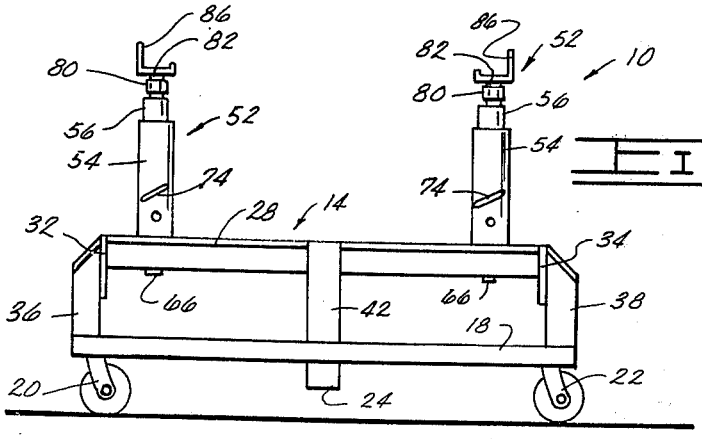
FIG. 7 is an end elevation view of the front stand shown in FIG. 6 with the view taken from the transverse end portion of the stand which is the end portion normally positioned in the center portion of a tractor.
Figure 8:
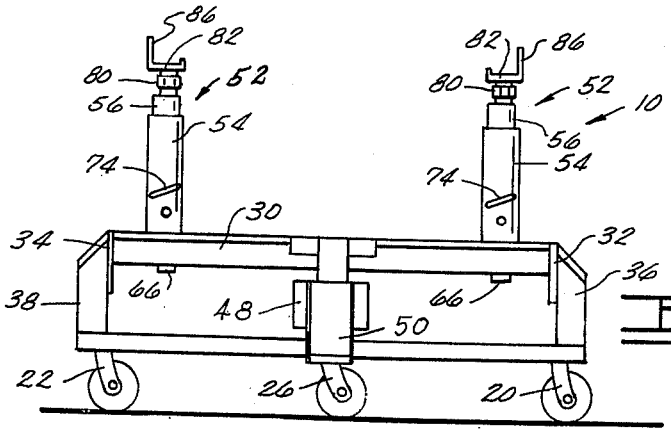
FIG. 8 is an end elevation view of the front stand as shown in FIG. 6 with the view taken from the end of the stand opposite to that shown in FIG. 7.

The front stand 10 is shown in FIG. 1 and in FIGS. 6–8 on Sheet 3 of the drawings. The front stand 10 has a frame that is comprised of a transverse frame portion 14 secured to one end of an elongated frame portion 16. The transverse frame portion 14 has a lower member 18 with caster wheel assemblies 20 and 22 mounted on opposed ends thereof. The elongated frame portion 16 has a lower member 24 which is rigidly secured on one end of the lower frame member 18. The unattached end of the lower frame member 24 has a caster wheel assembly 26 mounted thereon. The caster wheel assemblies 20, 22, and 26 have freely pivotable caster wheels which support the stand and rotate about a vertical axis so the stand can be easily moved about on a supporting surface.

Figure 9:
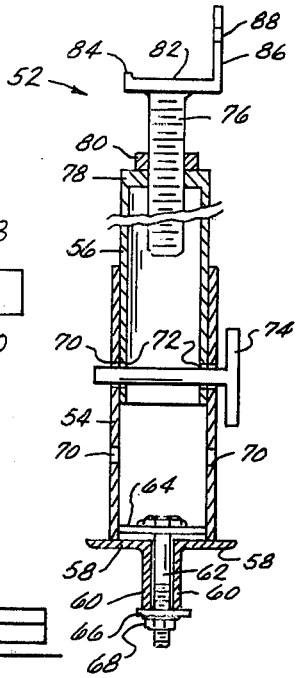
FIG. 9 is a shortened cutaway view of a telescopic support member mounted on a pair of support members.

The transverse frame portion 14 has an upper portion including a pair of elongated rail like members 28 and 30 rigidly mounted between plate members 32 and 34 which are in turn rigidly secured to upright members 36 and 38 extending upward from the lower transverse portion member 18. The elongated rail like members 28 and 30 are preferably cross-sectionally generally L-shaped members with one side being horizontally disposed on the upper portion and the other portions being vertically disposed and adjacent as shown in FIG. 9. The elongated frame portion 16 has upper members 40 and 41 above its lower member 24. The upper members 40 and 41 extend from the free end portion of the elongated frame portion 16 to the rail like member 30. The upper members 40 and 41 are rigidly secured to the center side portion of the rail like member 30. A vertically disposed support member 42 connects the upper members 40 and 41 and the lower member 24 underneath the rail like member 30. The upper members 40 and 41 are preferably generally cross-sectionally L-shaped members having the flat sides horizontally disposed on an upper portion thereof like shown in FIG. 9. A brace member 44 connects the mid portions of the lower member 24 and the upper members 40 and 41 for structural support. At the free end of the elongated frame portion 16 the caster wheel assembly 26 is mounted on the underneath side of a platform member 46 which is rigidly secured to the lower member 24 and to the upper members 40 and 41 by braces 48 and 50.

The front stand 10 has a pair of vertically disposed telescopic support members, indicated generally at 52, which are mounted on the frame's transverse portion 14. FIG. 9 shows a cut away view of a telescopic support member in mounted position on a pair of rail like support members. The telescopic member shown in FIG. 9 is typical of the telescopic members shown with the tractor stands of this invention. The telescopic support member 52 has a lower member 54 which slidably mounts an upper member 56. Preferably the lower member 54 and the upper member 56 are rectangular in cross section. The lower member 54 rests on top of the rail like members. The rail like members are preferably L-shaped members with each one having a horizontally disposed upper portion 58 and a vertically disposed lower portion 60. These members are positioned with the vertically disposed portions 60 being adjacent as shown. The lower member 54 is secured to the rails by a fastener or bolt 62. The bolt 62 is rigidly secured to a brace 64 that is rigidly mounted in the lower end portion of the lower member 54. A fastener plate 66 is positioned on the bolt 62 below the lowermost end of the rails vertically disposed portion 60 and secured by a nut 68. This construction allows the telescopic support member 52 to be removably mounted with the rails. It also lets the telescopic member 52 be slid along the rails when the nut 68 is loosened to adjust its position on the rails. Tightening the nut 68 engages the plate 66 and the rails to secure the telescopic member 52 in a fixed position. The lower member 54 has a plurality of apertures 70 on opposite sides thereof which cooperate with additional apertures 72 in the upper member 56. A locking pin 74 passed through the apertures 70 and 72 as illustrated to fix the vertical or extended position of the telescopic support member 52. On the upper end of the upper member 56 is a support member which in use is attached to the underneath side of a tractor. A threaded member 76 is threadedly mounted in the upper end portion 78 of the upper member 56. A lock nut 80 is provided to secure the threaded member 76. The support member is rigidly mounted on the upper end of the threaded member 76 and it is preferably a generally L-shaped member having a horizontally disposed portion 82 secured to the upper end of the threaded member 76. A lug portion 84 is located on one edge of the horizontally disposed portion 82. This support member has a vertically disposed portion 86 on the edge portion of the horizontal portion 82 which is oppositely disposed to the rigde 84. The vertically disposed portion can be provided with one or more apertures, as indicated at 88. The aperture 88 or multiple apertures are provided for securing the support member to some portion of a vehicle by a bolt or other fastener, if desired.

In using the front stand 10 of this invention it is positioned underneath the forward end portion of a frameless tractor 5 as shown in FIG. 1. The telescopic support members 52 are positioned alongside the rear portion of the engine portion of the tractor. The vertically disposed portion 86 of the support member can be attached to the sides of the engine if it permits. Otherwise the horizontally disposed portion 84 can be positioned underneath a horizontally disposed ledge like portion of the tractor's engine. Usually the oil pan of a tractor engine is constructed such that the horizontally disposed portion 82 of the support member can be easily positioned under its edge portion. In positioning the support members 52 the upper and lower telescopic members 56 and 54 can be adjusted vertically and secured with the pin 74. The threaded member 76 can be adjusted in a vertical position by rotating same and securing it with the block nut 80. When the front stand 10 is secured to the forward portion of a tractor then the tractor structure can be separated so the forward and rear portions thereof can be moved apart for maintenance.

At this point it is important to note the position of the telescopic members 52 in relation to the rear end portion of the stand. Because the telescopic members 52 are positioned toward the center portion of the stand 10 from the end of the transverse end portion 14 it allows the weight of the tractor's foward portion to be supported solely by the telescopic members 52 in combination with the front wheels of the tractor. The telescopic members 52 are positioned substantially from the vertical axis of support of the casters 20 and 22 along the transverse portion of the stand's frame. This specific construction of the front stand 10 prevents the stand from tipping due to the weight of the tractor's forward portion. It is not necessary to use a third upright support with the stand 10, however, it is possible to mount a third telescopic support member with the rail like members 40 and 41 of the stand if desired. The use of a third upright telescopic member with the stand 10 is not normally required for most agricultural type tractors. However, in the event the stand 10 is used with tractors or other vehicles wherein the weight or balanced support condition of the vehicle is such that a third telescopic support member is desirable then it can be mounted with the rail like members 40 and 41. A third telescopic member can be used with the others if the front wheels are to be removed or for some reason the front end of the tractor must be supported without using the front wheels. In mounting a third telescopic member with the rail like members 40 and 41 on the stand's elongated portion 16 it is secured the same as the telescopic support member 52 shown in FIG. 9. It can be positioned at any point along the rail like members 40 and 41 to provide the additional support as needed.

Figure 2:
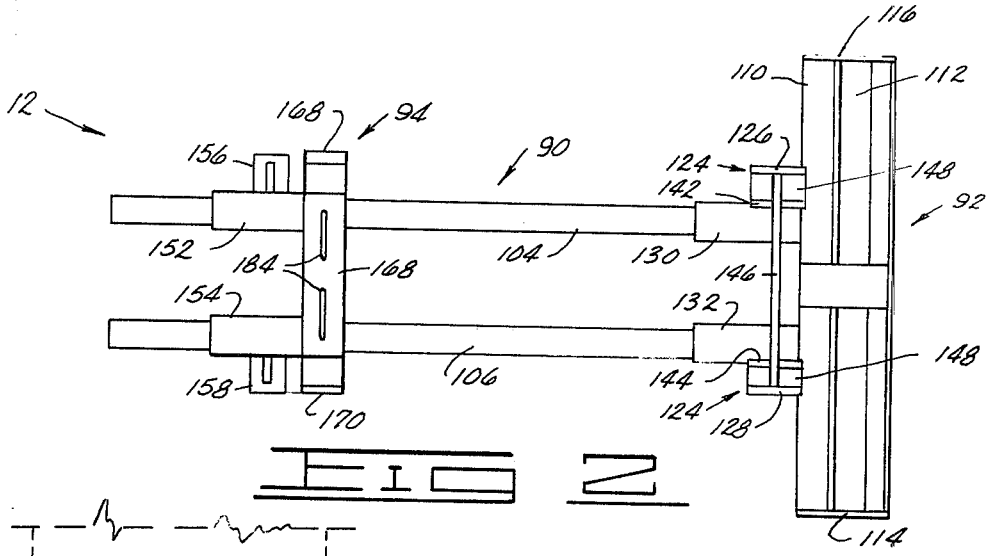
Figure 3:
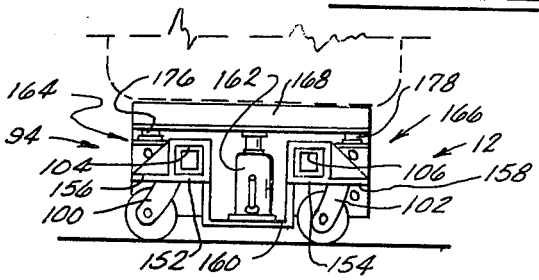
FIG. 3 is an end elevation view of the rear stand taken from the free end of the elongated portion thereof. Dashed lines show in outline form the drawbar portion of a tractor in position on the supporting member of the movably mounted portion of the stand.
Figure 4:
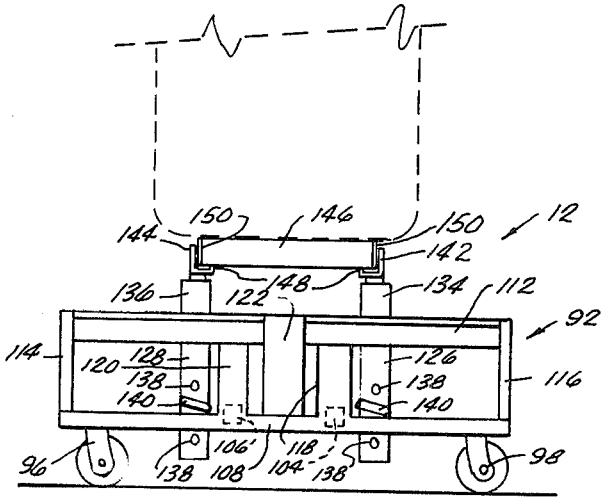
FIG. 4 is an end elevation view of the rear stand taken from the end that is normally positioned under the center portion of a tractor. Dashed lines show the center portion of a tractor structure resting on a transverse support member supported on the upright support members of the stand.
Figure 5:
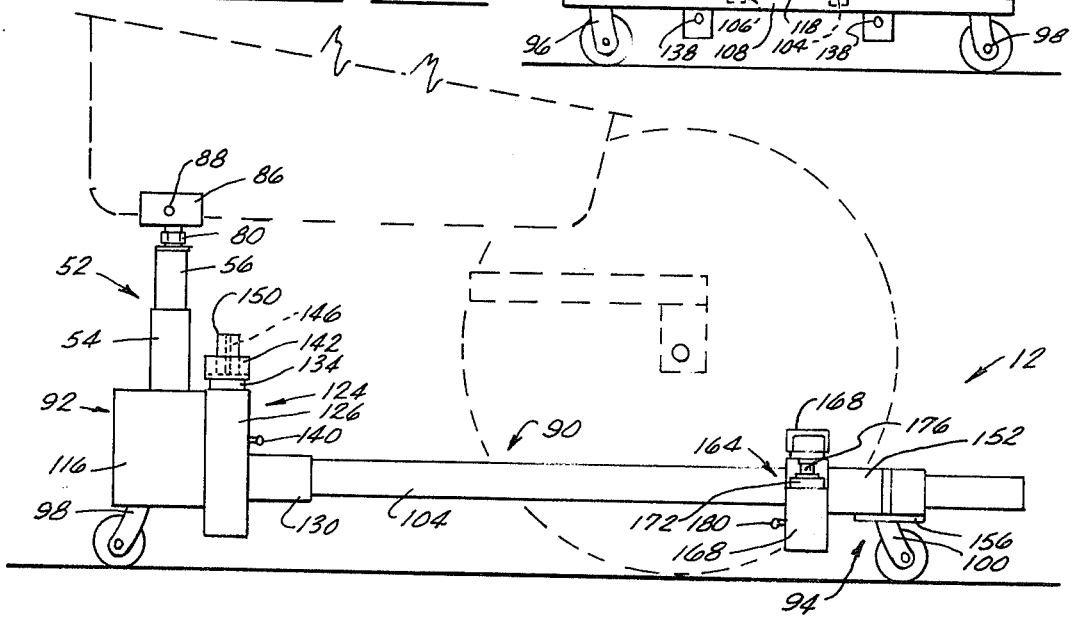
FIG. 5 is a side elevation view of the rear stand having auxiliary upright support members mounted on its transverse portion and being used to support the front end portion of a frameless tractor. Dashed lines illustrate a portion of the forward end portion of a frameless tractor.

FIGS. 1–5 show the rear stand 12 of this invention in its mounted position with the tractor and alone. The rear stand 12 has an elongated frame portion 90 with a transverse frame portion 92 rigidly secured to one end thereof. A movably mounted frame portion 94 is slidably mounted on the elongated frame portion 90. Opposed ends of the transverse frame portion 90 have caster wheel assemblies 96 and 98 mounted on the bottom thereof as shown in FIGS. 1, 4, and 5. The movable frame portion 94 has caster wheel assemblies 100 and 102 mounted on opposed sides of the bottom thereof as shown in FIGS. 1, 3, and 5. The individual caster wheel assemblies have a wheel which rolls on a supporting surface and can be rotated about a vertical axis. The caster wheel assemblies are provided for easy maneuvering of the stand.

The elongated frame portion 90 includes a pair of elongated members 104 and 106 which are rigidly secured on one end portion to the transverse frame portion 92. The elongated members 104 and 106 are preferably hollow cross sectionally rectangular members. The transverse frame portion 92 has an elongated lower member 108 which has the caster wheel assemblies 96 and 98 mounted on its underneath side. It also has an upper member consisting of a pair of rail like members 110 and 112. The rail like members 110 and 112 are supported above the lower member 108 and rigidly secured to end members 114 and 116. The rail like members 110 and 112 are displaced toward the center portion of the stand from the transverse end of the lower member 108 and the caster wheel assemblies 96 and 98. The elongated members 104 and 106 are secured to braces 118 and 120 which are rigidly mounted between the upper rail member 110 and the lower member 108. The braces 118 and 120 are visible in FIG. 4. An additional brace member 122 is provided between the rails 110 and 112 and the lower member 108 as shown in FIGS. 2 and 4.

A pair of upright positioned telescopic support members 124 mounted on the outwardly disposed sides of the elongated members 104 and 106. The telescopic members 124 are constructed similarly and each respectively includes lower members 126 and 128 rigidly secured to sleeves 130 and 132 on the elongated members 104 and 106, and upper members 134 and 136 slidably mounted with the lower members 126 and 128. The lower members 126 and 128 are provided with a plurality of apertures 138 which cooperate with apertures through the upper members 134 to receive and mount locking pins 140 for fixing the extended position of the telescopic member. Attached on the upper end of the upper members 134 and 136 are support members 142 and 144, respectively. The support members 142 and 144 are generally cross-sectionally L-shaped members threadedly telescopically mounted on the upper end members 134 and 136, respectively. The upper members 134 and 136, and the support members 142 and 144 are constructed like the upper portion of FIG. 9. In FIGS. 1, 4, and 5 the support members 142 and 144 are in an extreme lowered position. The support members 142 and 144 can be positioned under a tractor for supporting it if the structure is such that they can be suitably positioned. In the situation which is common the support members 142 and 144 cannot be effectively and safely attached to the tractor structure for supporting it in a stable manner, therefore, a removable cross member 146 is provided. Removable cross member 146 has feet 148 on its opposed ends which in use rest in the horizontally disposed portion of the L-shaped support members 142 and 144. At the ends of the cross member 146 upright members 150 extend upward from the feet and are secured to the opposed ends of the cross member 146.

The movably mounted frame portion 94 has a pair of sleeves 152 and 154 which are slidably mounted on the elongated members 104 and 106 of the frame's elongated portion 90. The sleeves 152 and 154 are provided with feet like extensions 156 and 158, respectively, which extend from their outward opposed sides for mounting the caster wheel assemblies 100 and 102, respectively. The sleeves are connected at one end portion by a generally U-shaped member 176 which is disposed between the sleeves. The center portion of the U-shaped member 160 is used for supporting a hydraulic type jack 162 as shown in FIG. 3. A pair of telescopic support members indicated generally at 164 and 166 are mounted on opposed outward sides of the sleeves 152 and 154, respectively. The telescopic members have a rear support member 168 mounted on their upper end portion. Each of the telescopic support members 164 and 166 has a lower member 168 and 170, respectively, which are rigidly secured to the sleeves 152 and 154, respectively; upper members 172 and 174, respectively which are slidably mounted with the lower members 168 and 170; and threaded members 176 and 178 which are threadedly telescopically mounted with the upper end of the upper members 172 and 174, respectively. The rear support member 168 spans the movable frame portion 94 and is mounted on top of the threaded members 176 and 178. The threaded members 176 and 178 are individually pivotally mounted with the rear support member 168. Each of the telescopic support members 164 and 166 are provided with apertures through the lower members 168 and 170 and through the upper members 172 and 174 to receive and mount locking pins 180 and 182 for securing the telescopic members in a fixed position. In use the apertures and locking pins are used to adjustably position the rear support member 168 roughly and the threaded members 176 and 178 are used for more precise adjustment. The jack 162 is placed in the U-shaped member 160 with the vertically movable member thereof in contact with the underneath side of the rear support member 168. The rear support member 168 is preferably provided with a pair of elongated slot like apertures indicated at 184 so it can be bolted to some structure of a vehicle when in use.

In use and operation of the rear stand 12 of this invention it is initially positioned underneath a frameless tractor 5 or other vehicle as shown in FIG. 1. The cross member 146 is positioned under some mid portion of the tractor structure to the rear of the point where the tractor is to be separated. The rear support member 168 is positioned underneath a suitable structural portion of the tractor. In many cases the rear support member 168 can be positioned under the drawbar portion of a tractor. At this time, if desired, for safety and/or stability reasons the rear support member 168 can be bolted to the tractor structure by using the apertures 184 through the support member 168. Once the rear stand 12 is connected with the tractor structure the front stand 10 can be mounted with the tractor structure. Actuating the jack 162 raises the rear support member 168 and in turn raises the rear end of the tractor 5 so the wheels are raised above the ground level. When this is done the threaded members 176 and 178 at the movable frame portion 94 are adjusted to fix the vertical position of the tractor 5 relative to the stand so the jack 162 can be removed if desired. Additionally, at this time the telescopic members 124 at the transverse frame portion 92 can be adjusted so the cross member 146 is supporting the forward mid portion of the tractor. The front stand 10 is then positioned and/or adjusted by extending the telescopic members 52 so the front stand 10 will support the rear portion of the tractor's engine or forward portion. When all adjustments have been completed a mechanic can disconnect the separable portions of the tractor structure to separate or split the tractor 5. In using the stands 10 and 12 to reassemble the frameless tractor 5 the threaded adjustment of the upper end portions of the several telescopic members provide for precise alignment of the separate portions of the tractor so that it can be reassembled relatively easily and with little danger to the mechanic or the machine.

In using the rear stand 12 of this invention it is to be noted that it is constructed so it can be used under the front of the tractor as well as under the rear. FIG. 5 shows the rear stand 12 positioned in the forward end portion of a tractor that is shown in dashed lines. When the rear stand 12 is used in this situation a pair of telescopic members are mounted on the rail like members 110 and 112 on the transverse end portion 92. For convenience a pair of telescopic members 52 as shown in FIG. 9 are mounted on the stand's transverse end portion 92. The stand 12 is positioned with the transverse end portion 92 underneath the mid portion of a tractor with the telescopic members 52 in a position to connect with a rear portion of the tractor's engine. Here as with front stand 10 the telescopic support members 52 are positioned in a spaced relation from the end transverse of the stand 12 to prevent tipping. The novel structure of the rear stand 12 of this invention which allows it to be used under the forward end portion of a tractor or under the rear end portion of a tractor is an important feature of the invention because it makes the stand more versatile. In large tractor repair shops where a plurality of stands are used the rear stand 12 can be effectively used in its dual capacity most effectively so there is no shortage of stands to support the tractors while they are awaiting repair.

In manufacture of the tractor stands of this invention it is obvious that both stands can be easily constructed to achieve the end product. The stands are somewhat less complicated structurally than many engine stands and vehicle support structures in the prior art. The stands can be easily fabricated from standard sizes of stock material without requiring any extensive amount of special tooling and the like.

In the use and operation of the tractor stands of this invention it is seen that same provides a set of stands for supporting a frameless tractor or other vehicles which must be split or separated for repair. The stands provide stable and easily usable structures for use and repair of frameless tractors and other vehicles.

As will become apparent from the foregoing description of the applicant's tractor stands relatively inexpensive and simple means have been provided to support the separable portions of a frameless tractor or other separable frameless type vehicles so it can be easily supported and separated for repair. The stand structures are simple to use and can be easily used by one person. The stands are constructed to support relatively heavy tractor structures without tipping to increase the safety in using such devices.

While the invention has been described in conjunction with preferred specific embodiments thereof, it will be understood that this description is intended to illustrate and not to limit the scope of the invention, which is defined by the following claims.

I claim:

1. A vehicle support stand for supporting the forward and rear portion of a tractor or the like when the vehicle is disassembled for maintenance as its midsection between the vehicle's front and rear wheels, the support stand comprising:

a front stand including:

an elongated frame having a lower portion and an upper portion:

a transverse frame secured to one end of said elongated frame, said transverse frame having a lower portion and an upper portion, the upper portion including a pair of elongated rail-like members:

a pair of telescopic supports mounted on the rail-like members of said transverse frame for supporting the engine of the vehicle; and caster wheels attached to the ends of the lower portion of said transverse frame and the lower portion of the opposite end of said elongated frame;

a rear stand including:

an elongated frame having a pair of elongated rectangularly shaped members;

a transverse frame secured to one end of the pair of the elongated rectangularly shaped members of said elongated frame, said transverse frame having an upper portion and a lower portion;

a cross support member for supporting a mid portion of the frame of the vehicle;

a pair of telescopic supports mounted on the rectangularly shaped members of said elongated frame, said pair of said telescopic supports supporting said cross support member thereon;

a movably mounted frame having a pair of sleeves at the ends thereof for slidably mounting on the pair of rectangularly shaped members of said elongated frame;

a rear support member for supporting a rear portion of the frame of the vehicle;

a pair of telescopic supports mounted on said movably mounted frame, said pair of telscopic support members supporting said rear support member thereon; and caster wheels attached to the ends of the lower portion of said transverse frame and the lower portion of the movably mounted frame.

2. The support stand as described in claim 1, wherein said pair of telescopic supports of said front stand are slidably mounted on the rail-like members of said transverse frame so that the telescopic supports can be positioned to the width of the vehicle engine for supporting the engine thereon.

3. The support stand as described in claim 1, wherein said pair of telescopic supports of said front stand are positioned between the vertical axis of said caster wheels attached to the lower portion of said transverse frame and the upper portion of said elongated frame so that said front stand will not tip due to the weight of the forward portion of the vehicle when the vehicle's front wheels are removed.

4. The support stand as described in claim 1, wherein said pair of telescopic supports mounted on said elongated frame and said movably mounted frame of said rear stand are positioned between the vertical axis of the caster wheels attached to the lower portion of said transverse frame and the lower portion of said movably mounted frame so that said rear stand frame will not tip due to the weight of the rear portion of the vehicle when the vehicle's rear wheels are removed.

5. The support stand as described in claim 1, wherein a center portion of said movably mounted frame of said rear stand includes a jack mounted thereon, the upper portion of said jack disposed against the center portion of said rear support member for raising and lowering said rear support thereon.

6. The support stand as described in claim 1, wherein said upper portion of said transverse frame includes a pair of rail like members and there is a pair of telescopic supports mounted on said rail like members thereby providing that said rear stand can be used as a front stand.

* * * * *

UNITED STATES PATENT OFFICE

CERTIFICATE OF CORRECTION

PATENT NO. : 3,949,976
DATED : April 13, 1976
INVENTOR(S) : Robert E. Cofer

It is certified that error appears in the above-identified patent and that said Letters Patent are hereby corrected as shown below:

Column 3, line 33, delete "of" and insert therefor ---to---.

Claim 1, Column 8, line 52, delete "as" and insert therefor ---at---.

Signed and Sealed this

*eighth* Day of *June 1976*

[SEAL]

*Attest:*

RUTH C. MASON
*Attesting Officer*

C. MARSHALL DANN
*Commissioner of Patents and Trademarks*